US006337668B1

(12) United States Patent
Ito et al.

(10) Patent No.: US 6,337,668 B1
(45) Date of Patent: Jan. 8, 2002

(54) ANTENNA APPARATUS

(75) Inventors: Hideo Ito, Yokosuka; Takashi Enoki, Yokohama; Suguru Kojima, Yokosuka, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/514,274

(22) Filed: Feb. 28, 2000

(30) Foreign Application Priority Data

| | | |
|---|---|---|
| Mar. 5, 1999 | (JP) | 11-059449 |
| May 19, 1999 | (JP) | 11-139122 |
| Aug. 18, 1999 | (JP) | 11-231381 |

(51) Int. Cl.[7] ..... H01Q 19/00; H01Q 19/10
(52) U.S. Cl. ..... 343/833; 343/834; 343/837
(58) Field of Search ..... 343/833, 834, 343/836, 837, 876, 893; H01Q 19/00, 19/10

(56) References Cited

U.S. PATENT DOCUMENTS

| | | | | |
|---|---|---|---|---|
| 3,560,978 A | * | 2/1971 | Himmel | 343/893 |
| 3,725,938 A | * | 4/1973 | Black et al. | 343/833 |
| 3,846,799 A | * | 11/1974 | Gueguen | 343/833 |
| 4,169,266 A | * | 9/1979 | Bachvarov | 343/853 |
| 5,231,413 A | * | 7/1993 | Dubois | 343/833 |
| 5,995,064 A | * | 11/1999 | Yanagisawa et al. | 343/702 |

FOREIGN PATENT DOCUMENTS

| | | |
|---|---|---|
| JP | 8335825 | 12/1996 |
| JP | 9036654 | 2/1997 |
| JP | 11027038 | 1/1999 |

* cited by examiner

*Primary Examiner*—Hoanganh Le
(74) *Attorney, Agent, or Firm*—Stevens, Davis, Miller & Mosher, LLP

(57) ABSTRACT

The antenna apparatus of the present invention places antenna element 302 that transmits or receives electromagnetic waves on basic plate 301, places parasitic antenna elements 303 to 306 on basic plate 301 evenly spaced concentrically centered on antenna element 302, places switch elements 307 to 310 and capacitances 311 to 314 in parallel between one end of each of antenna elements 303 to 306 and said basic plate and disconnects one of switch elements 307 to 310 and connects all the others. In this way, the present invention provides a small and high-gain antenna apparatus with directivity switching capability.

35 Claims, 15 Drawing Sheets

ANTENNA APPARATUS

BACKGROUND OF THE INVENTION

1. Field of the Invention

The present invention relates to an antenna apparatus with directivity switching capability used for a communication terminal apparatus and base station apparatus, etc. in a radio communication system.

2. Description of the Related Art

In radio communications, it is desirable to radiate electromagnetic waves focused on a specific direction and one of the antennas that realize this objective is Yagi antenna. The Yagi antenna is an antenna that controls directivity (radiation direction) by means of the length of a conductor bar placed near a ½ wavelength dipole antenna.

This antenna utilizes the nature of radiation direction that inclines toward a parasitic conductor bar placed near an antenna element, which acts as a radiator, if this conductor bar is shorter than ½ wavelength, and inclines toward the opposite direction of the conductor bar if the conductor bar is longer than ½ wavelength.

Hereafter, an antenna element with directivity toward itself is called "director" and an antenna element with directivity toward its opposite direction is called "reflector". The measure used to indicate the sharpness of directivity is called "gain".

Here, in radio communications, there are cases where it is necessary to switch directivity, for example, to minimize a multipath phenomenon that the radio traveling direction varies depending on the transmission environment. As the apparatus with directivity switching capability, the one using an array of a plurality of Yagi antennas made up of 3 elements of reflector, radiator and director is already proposed.

Here, it is possible to achieve higher gain by forming directivity by setting the director and reflector at symmetric positions with respect to the radiator rather than forming directivity using either one of the director or reflector.

FIG. 1A and FIG. 1B show a configuration of a conventional antenna apparatus whose directivity can be changed by 90 degrees.

As shown in FIG. 1A and FIG. 1B, the conventional antenna apparatus consists of basic plate 1, 4 arrays of 3 elements of reflector 2, radiator 3 and director 4 placed in ¼ wavelength intervals on basic plate 1 and distributed in 90-degree intervals on the horizontal plane, switch circuit 4 inserted into the output of radiator 3 of each antenna array and switching circuit 5 that switches connection/disconnection of switch circuit 4. The reason that the antenna elements are placed in ¼ wavelength intervals is that the antenna element interval smaller that this would reduce impedance due to mutual coupling.

The conventional antenna apparatus above implements switching of directivity by 90 degrees by changing switching circuit 5 as shown in the directivity diagram in FIG. 2.

However, the conventional antenna apparatus requires the same number of Yagi antenna arrays with antenna element intervals of approximately ¼ wavelength, as the number of directivities to be switched, causing a problem of increasing the size of the apparatus.

Furthermore, the conventional antenna apparatus has a switch circuit inserted into each radiator output, which will cause another problem that the antenna gain will be reduced due to loss in those switch circuits.

SUMMARY OF THE INVENTION

It is an objective of the present invention to provide a small, high-gain antenna apparatus with directivity switching capability.

The present invention achieves the objective above by placing a first antenna element that transmits/receives electromagnetic waves and a parasitic second antenna element on a basic plate, inserting a switching section between one end of the second antenna element and the basic plate, connecting or disconnecting the switching section and thereby making the second antenna element act as a reflector or director.

BRIEF DESCRIPTION OF THE DRAWINGS

The above and other objects and features of the invention will appear more fully hereinafter from a consideration of the following description taken in connection with the accompanying drawing wherein one example is illustrated by way of example, in which.

DETAILED DESCRIPTION OF THE PREFERRED EMBODIMENTS

With reference now to the attached drawings, the embodiments of the present invention are explained in detail below.

(Embodiment 1)

Figure 1A:
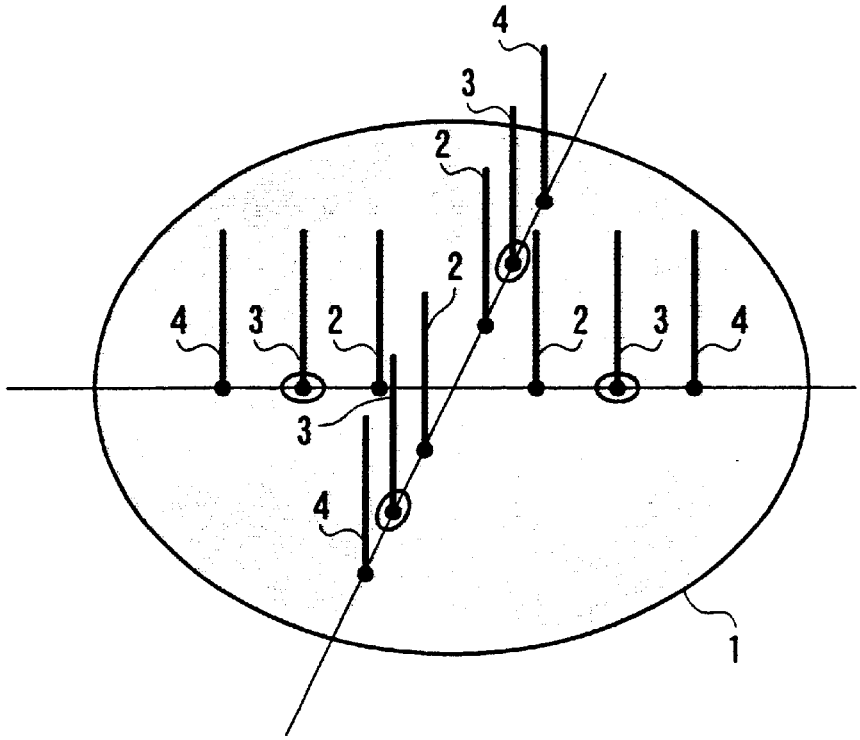
PRIOR ART FIG. 1A
FIG. 1A is diagrams showing a configuration of a conventional antenna apparatus.
Figure 1B:
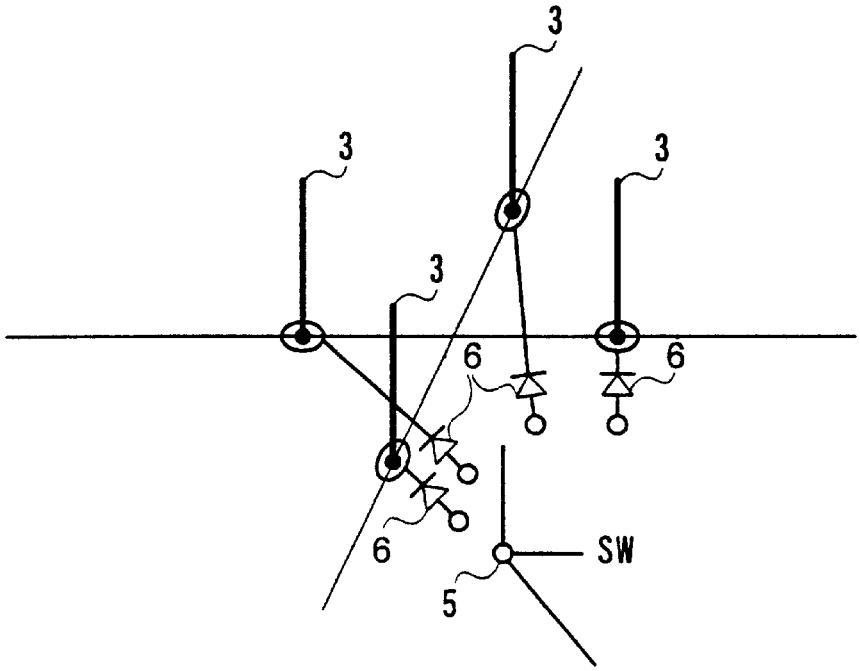
PRIOR ART FIG. 1B
FIG. 1B is diagrams showing a configuration of a conventional antenna apparatus.
Figure 2:
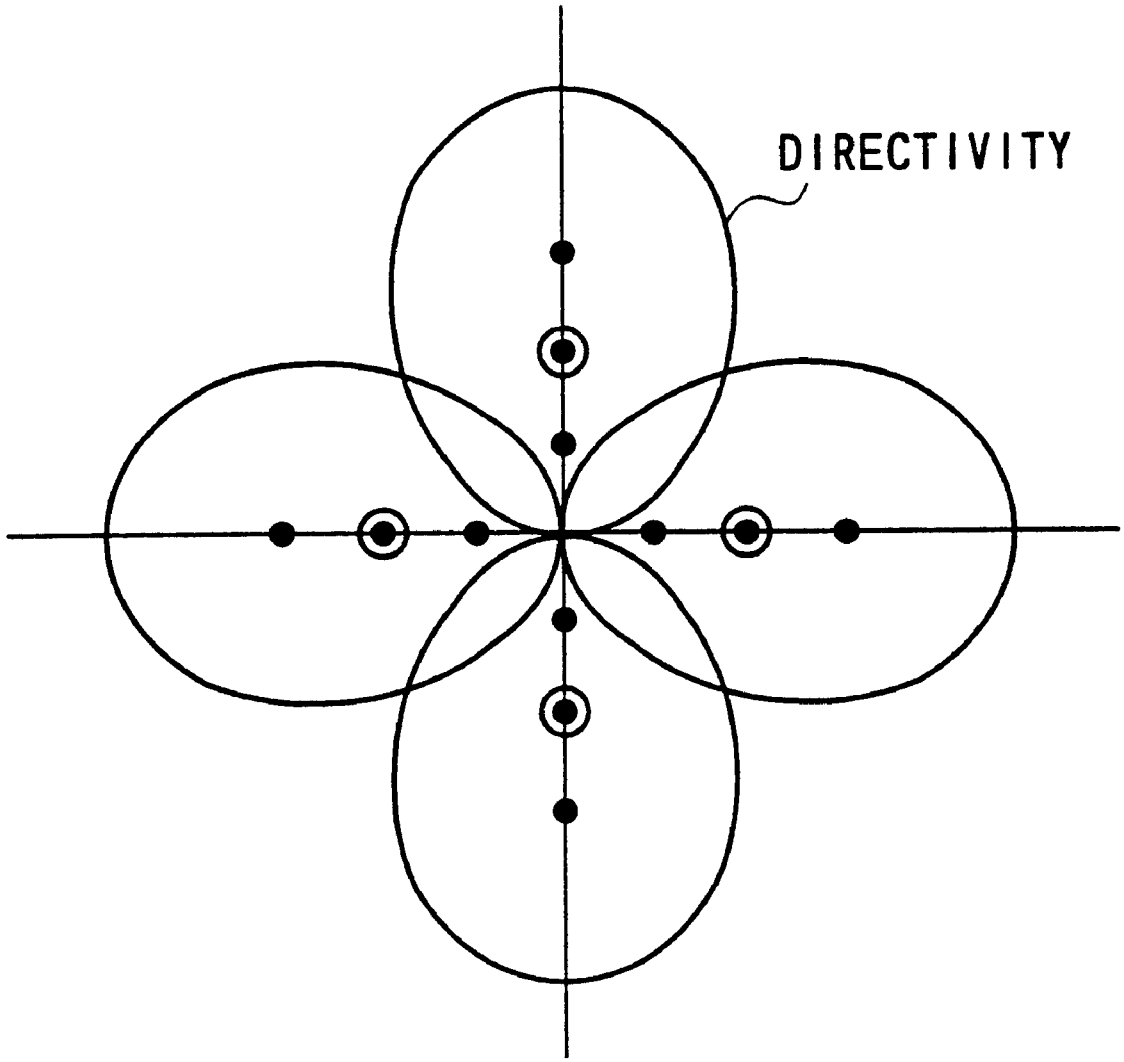
FIG. 2 is a directivity diagram showing the conventional antenna apparatus.
Figure 3:
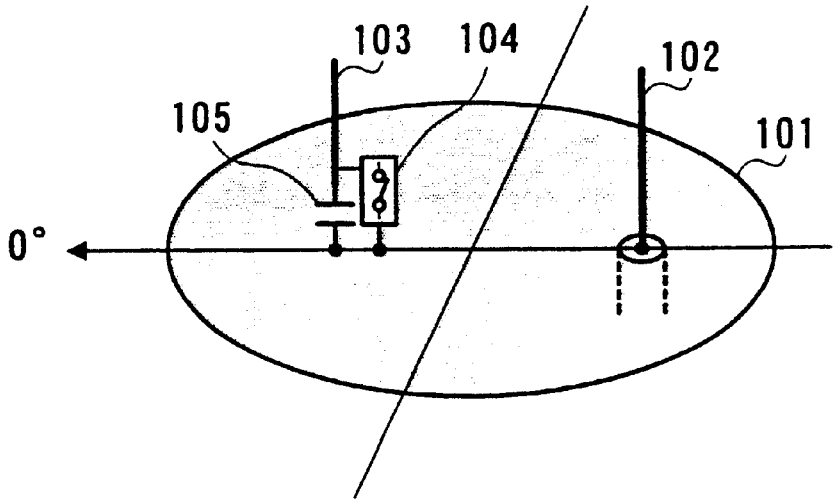
FIG. 3 is a diagram showing a first configuration of an antenna apparatus according to Embodiment 1 of the present invention.

FIG. 3 is a diagram showing a configuration of an antenna apparatus according to Embodiment 1 of the present invention.

As shown in FIG. 3, the antenna apparatus according to the present embodiment comprises antenna element 102 acts as a radiator and parasitic antenna element 103 on basic plate 101, and switch circuit 104 and capacitance 105 are connected in parallel between one end of antenna element 103 and basic plate 101. Insertion of capacitance 105 allows the antenna element to act as a reflector even if the distance between antenna elements is narrowed from its conventional length of approximately ¼ wavelength.

Figure 4:
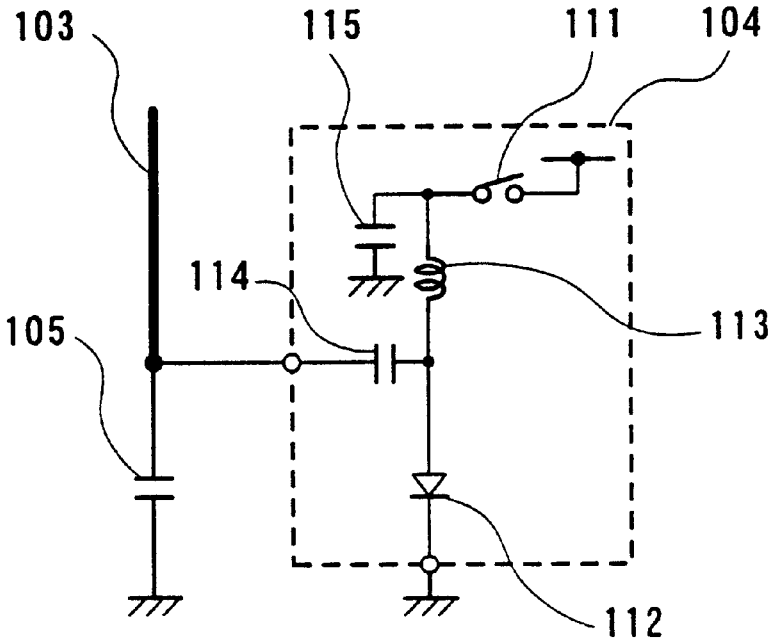
FIG. 4 is a diagram showing a configuration example of a switch circuit of the antenna apparatus according to Embodiment 1 of the present invention.

FIG. 4 is a diagram showing an internal configuration of switch circuit 104 of the antenna apparatus according to Embodiment 1.

As shown in FIG. 4, switch circuit 104 mainly comprises switch 111, diode element 112, choke inductance 113, capacitance 114 and capacitance 115. Switch circuit 104 turns ON diode element 112 by closing switch 111 to apply a bias via choke inductance 113, and turns OFF diode element 112 by opening switch Ill to apply no bias to diode element 112.

Choke inductance 113 is inserted to produce high impedance on the power supply side to prevent a high frequency component entering from the antenna from entering into the power supply side. Capacitance 114 is inserted to prevent any current from flowing into the antenna side when a voltage is applied via choke inductance 113 to turn ON diode element 112 when switch 111 is closed. Capacitance 115 is inserted to short the high frequency component entering from the antenna to avoid the high frequency component from entering into the power supply side.

Here, when switch circuit 104 is ON, if antenna element 103 is electrically continuous with basic plate 101 and if antenna element 103 is a little longer than antenna element 102 acts as a radiator, antenna element 103 acts as a reflector. On the other hand, when switch circuit 104 is OFF, if capacitance 105 is set so that the phase of impedance produced by antenna element 103 and capacitance 105 lags behind antenna element 102, antenna element 103 acts as a director.

Figure 5:
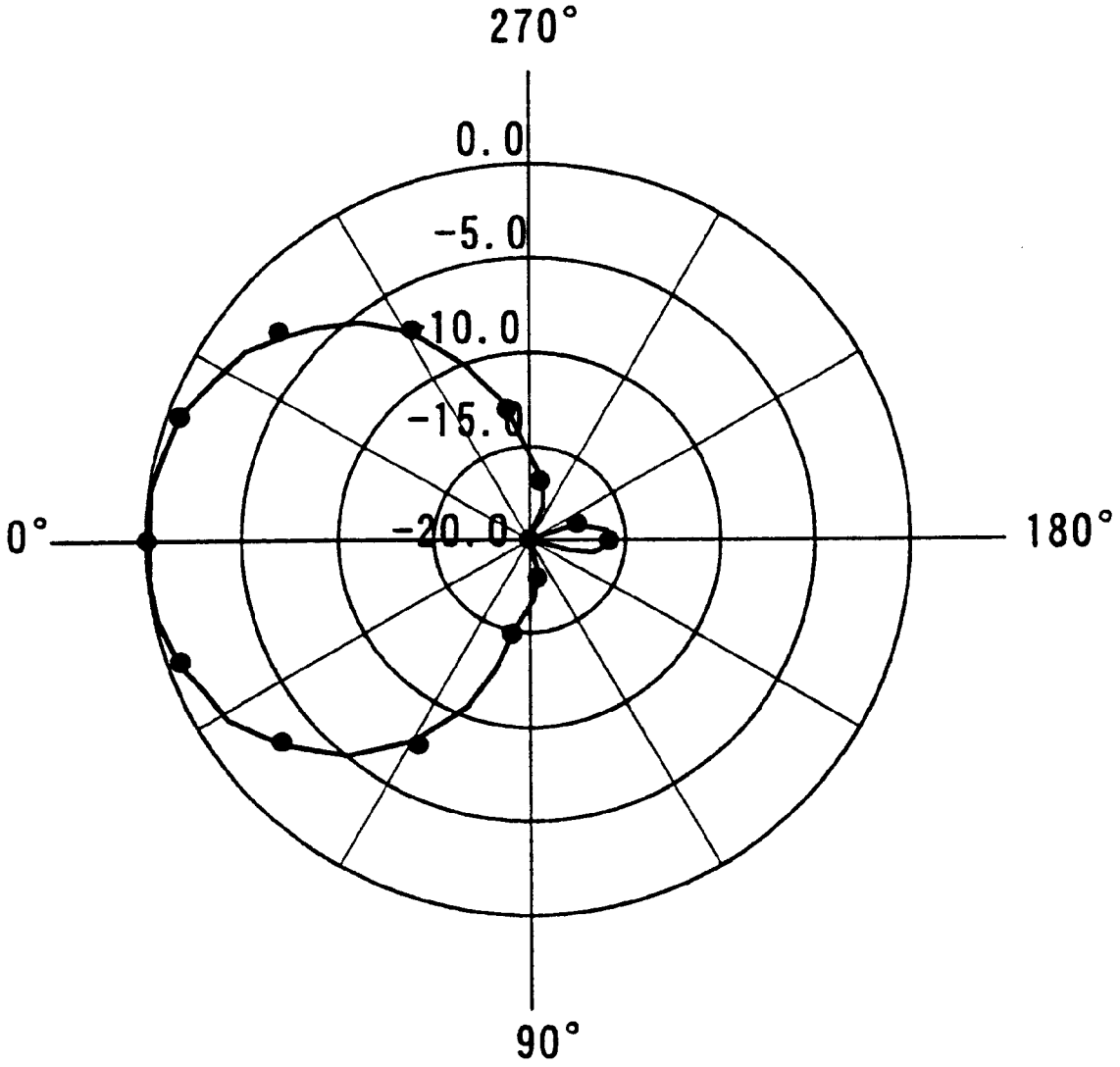
FIG. 5 is a directivity diagram of the antenna apparatus according to Embodiment 1 of the present invention.

FIG. 5 shows a directivity diagram showing actually measured values of directivity at 2 GHz of a specific example of the antenna apparatus in FIG. 3, with circular basic plate 101 of approximately 75 mm in diameter, antenna element 102 of approximately 34.5 mm in length, antenna element 103 of approximately 37 mm in length, distance between antenna element 102 and antenna element 103 of approximately ⅛ wavelength, capacitance 105 of approximately 2 pF when switch circuit 104 is OFF.

As shown in FIG. 5, when switch circuit 104 is OFF, the direction of maximum radiation is toward antenna element 103. On the other hand, when switch circuit 104 is ON, the direction of maximum radiation is toward antenna element 102.

Thus, the present embodiment provides a switch circuit and capacitance in parallel between one end of a parasitic antenna element placed near a radiator and a basic plate, makes the parasitic antenna element act as a reflector or director by turning ON/OFF the switch circuit and makes the parasitic antenna element act as a reflector even if the distance between antenna elements is ¼ wavelength or below, thus making it possible to implement a small antenna apparatus capable of switching directivity in 2 directions. Furthermore, since the switch circuit is not provided at the output of the radiator, the present embodiment provides a high-gain antenna apparatus without loss caused by the switch circuit.

Here, it is also possible to implement the basic plate using a printed circuit board and mount switch circuit 104 and capacitance 105 on the rear of the printed circuit board. This will facilitate manufacturing of an antenna in a normal manufacturing process and provide an antenna with high reproducibility in the characteristic aspect.

Figure 6:
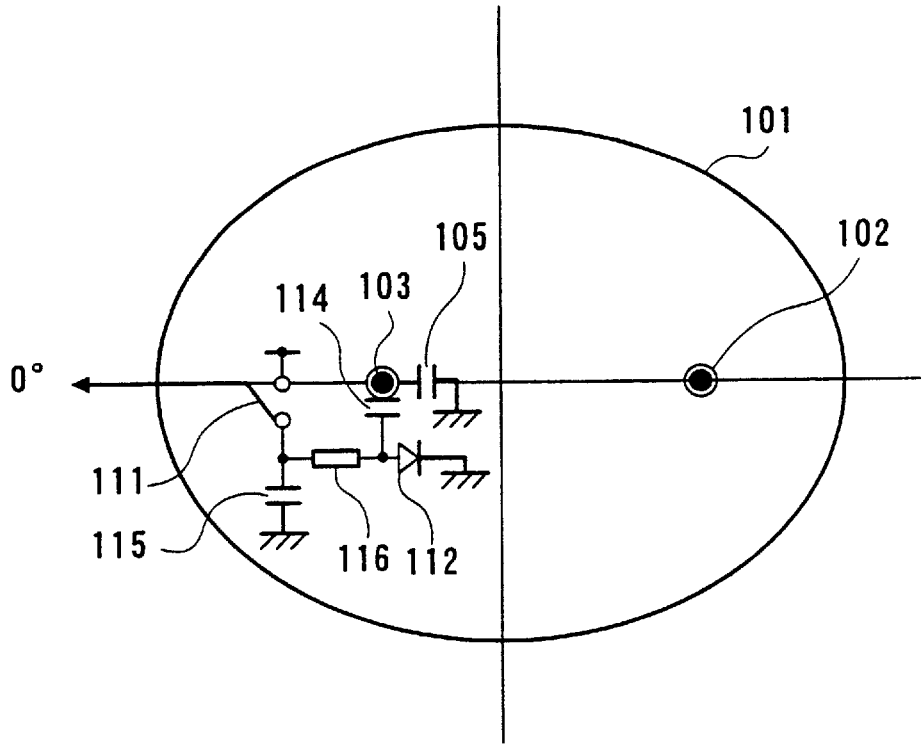
FIG. 6 is a rear view of a printed circuit board of the antenna apparatus according to Embodiment 1 of the present invention.

Furthermore, as shown in the rear view of the printed circuit board of the antenna apparatus in FIG. 6, it is also possible to use transmission line 116 of ¼ wavelength instead of choke inductance 113 to short between the power supply side of ¼ wavelength transmission line 116 and the basic plate by means of high frequency using capacitance 115 and open its opposite side, thus reducing influences on the power supply side.

This can solve a problem that with a choke inductance of approximately 2-GHz band, the inductance does not match its nominal value making it impossible to obtain sufficient impedance, and achieve sufficient impedance even in a high frequency band.

Figure 7:
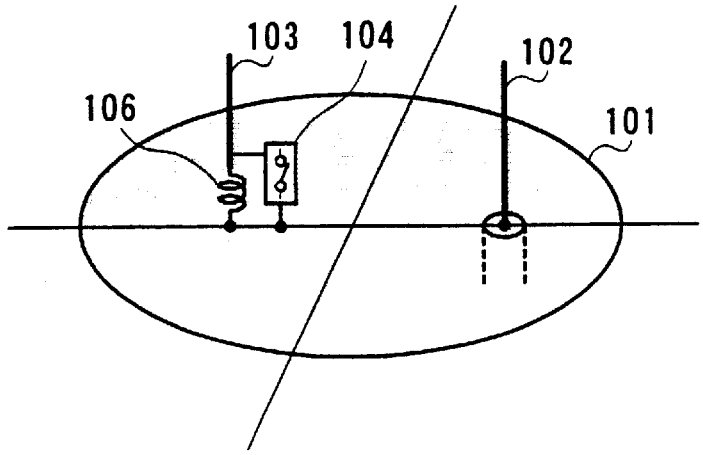
FIG. 7 is a diagram showing a second configuration of the antenna apparatus according to Embodiment 1 of the present invention.

FIG. 7 shows a configuration of the antenna apparatus in FIG. 3 using inductance 106 instead of capacitance 105.

In the case of FIG. 7, when switch circuit 104 is ON, antenna element 103 is electrically continuous with basic plate 101 and antenna element 103 acts as a director. When switch circuit 104 is OFF, inductance 106 is loaded and antenna 103 acts as a reflector.

In this way, the present embodiment can make the parasitic antenna element act as a reflector or director and make the parasitic antenna element act as a reflector even if the distance between the antenna elements is ¼ wavelength or below, thus making it possible to implement a small antenna apparatus capable of switching directivity in 2 directions. Furthermore, since the switch circuit is not provided at the output of the radiator, the present embodiment provides a high-gain antenna apparatus without loss caused by the switch circuit.

(Embodiment 2)

Embodiment 2 is an embodiment configuring an antenna apparatus with 3 antenna elements in order to achieve an antenna apparatus with higher gain than Embodiment 1.

Figure 8:
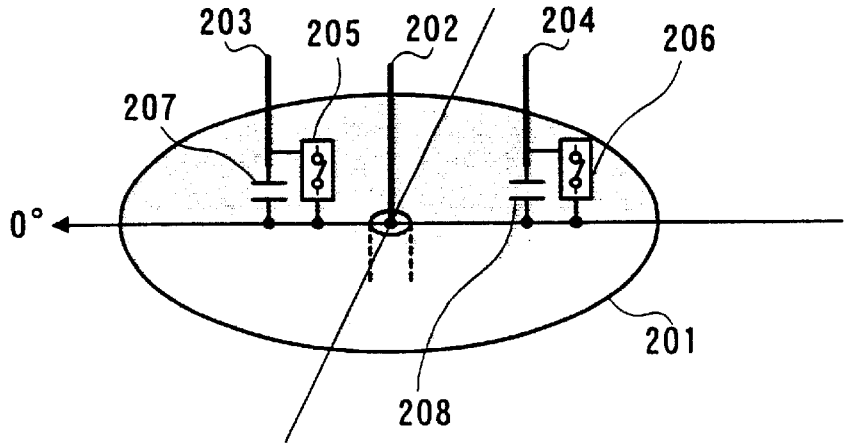
FIG. 8 is a diagram showing a first configuration of an antenna apparatus according to Embodiment 2 of the present invention.

FIG. 8 shows a configuration of the antenna apparatus according to Embodiment 2.

FIG. 8 is a diagram showing a configuration of the antenna apparatus according to Embodiment 2.

As shown in FIG. 8, the antenna apparatus according to the present embodiment comprises antenna element 202 that acts as a radiator at the center of the upper surface of basic plate 201, antenna elements 203 and 204 that act as either a reflector or director arrayed on a straight line so that their respective distance from antenna element 202 is ¼ wavelength or less. The antenna apparatus according to the present embodiment provides switch circuits 205 and 206 and capacitances 206 and 207 in parallel between one end of each of antenna elements 203 and 204 and basic plate 201, respectively.

Here, when switch circuit 205 is ON, if antenna element 203 is electrically continuous with basic plate 201 and if antenna element 203 is a little longer than antenna element 102 acts as a radiator, antenna element 203 acts as a reflector. On the other hand, when switch circuit 205 is OFF, if capacitance 207 is set so that the phase of impedance produced by antenna element 203 and capacitance 207 lags behind antenna element 202, antenna element 203 acts as a director. Likewise, when switch circuit 206 is ON, antenna element 204 acts as a reflector and when switch circuit 206 is OFF, antenna element 204 acts as a director.

That is, it is possible to make one of antenna element 203 or antenna element 204 act as a director and the other act as a reflector by turning ON either of switch circuit 205 or switch circuit 206 and turning OFF the other.

Figure 9:
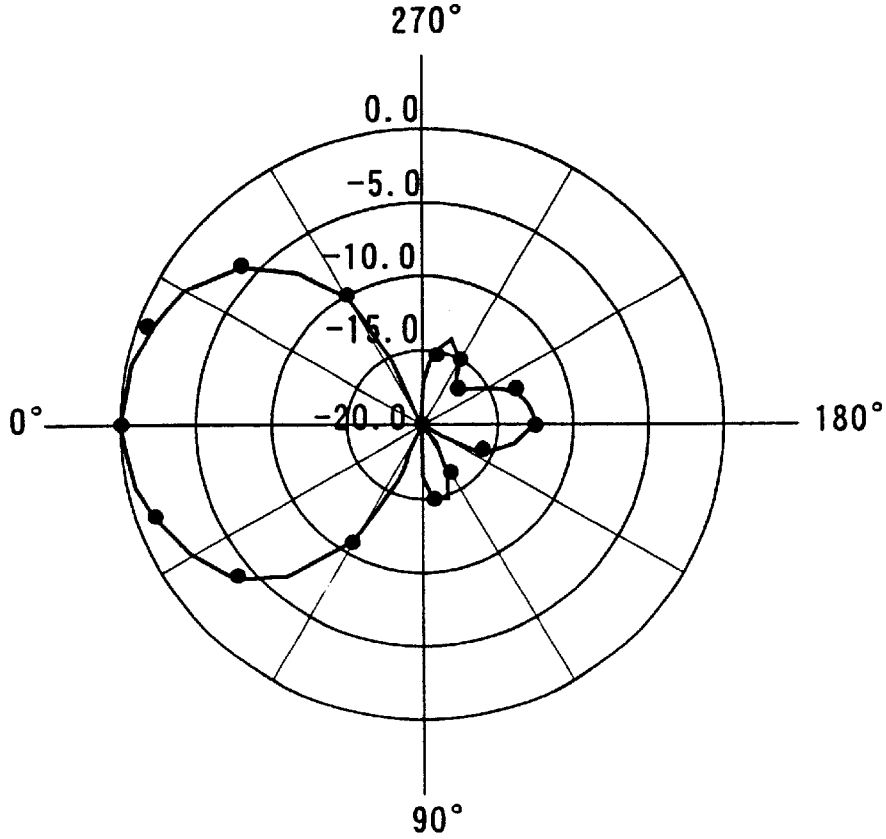
FIG. 9 is a directivity diagram of the antenna apparatus according to Embodiment 2 of the present invention.

FIG. 9 shows a directivity diagram showing actually measured values of directivity at 2 GHz of a specific example of the antenna apparatus in FIG. 8, with circular basic plate 201 of approximately 75 mm in diameter, antenna element 202 of approximately 34.5 mm in length, antenna elements 203 and 204 of approximately 37 mm in length, distance between antenna element 202 and antenna element 203 and distance between antenna element 202 and antenna element 204 of approximately ⅛ wavelength, capacitances 207 and 208 of approximately 2.7 pF when switch circuit 205 is OFF and switch circuit 206 is ON.

As shown in FIG. 9, when switch circuit 205 is OFF and switch circuit 206 is ON, the direction of maximum radiation is toward antenna element 203. On the other hand, when switch circuit 205 is ON and switch circuit 206 is OFF, the direction of maximum radiation is toward antenna element 204.

Thus, the present embodiment provides switch circuits and capacitances in parallel between one end of each of two parasitic antenna elements placed symmetrically with respect to a radiator at the center and a basic plate, respectively, makes one of the two parasitic antenna elements act as a reflector and the other as a director by switching ON/OFF of the switch circuits so that one of the switch circuits is ON and the other is OFF, and in this way can implement an antenna apparatus with higher gain than Embodiment 1.

By the way, according to FIG. 8, both antenna elements 203 and 204 act as reflectors or directors by turning ON or OFF both switch circuits 205 and 206, and in this way it is possible to use this antenna apparatus as an isotropic antenna on a horizontal plane without performing complicated switching operations.

Figure 10:
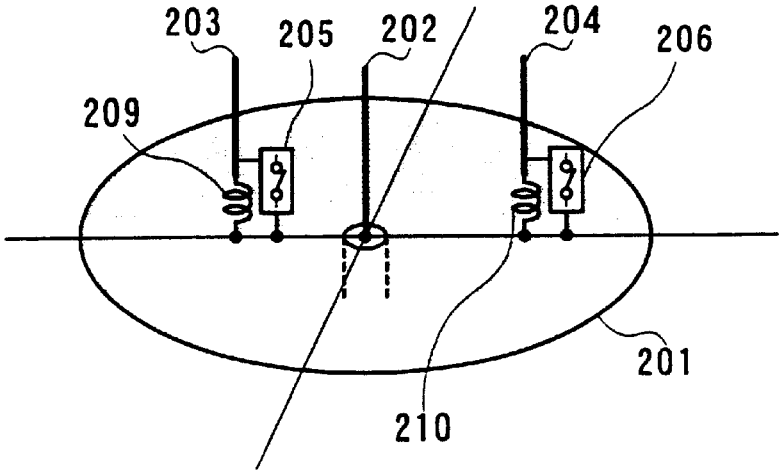
FIG. 10 is a diagram showing a second configuration of the antenna apparatus according to Embodiment 2 of the present invention.

As opposed to the antenna apparatus in FIG. 8, FIG. 10 shows a configuration of the antenna apparatus using inductances 209 and 210 instead of capacitances 207 and 208.

In FIG. 10, when switch circuit 205 is ON, antenna element 203 is electrically continuous with basic plate 201 and antenna element 203 acts as a director. When switch circuit 205 is OFF, inductance 209 is loaded and antenna 203 acts as a reflector. Likewise, when switch circuit 206 is ON, antenna element 204 is electrically continuous with basic plate 201 and antenna element 204 acts as a director. When switch circuit 206 is OFF, antenna element 204 is isolated from basic plate 201 and inductance 210 is loaded and antenna 204 acts as a reflector.

That is, in the antenna apparatus shown in FIG. 10, one of antenna elements 203 and 204 acts a director and the other acts as a reflector by turning ON one of either switch circuit 205 or switch circuit 206 and turning OFF the other, thus implementing an antenna apparatus with higher gain than Embodiment 1 as in the case of the antenna apparatus shown in FIG. 8.

According to FIG. 10, both antenna elements 203 and 204 act as reflectors or directors by turning ON or OFF both switch circuits 205 and 206, and in this way it is possible to use this antenna apparatus as an isotropic antenna on a horizontal plane without performing complicated switching operations.

(Embodiment 3)

Embodiment 3 is an embodiment configuring an antenna apparatus with 5 antenna elements in order to implement a small and high-gain antenna apparatus with the capability of switching directivity by 90 degrees.

Figure 11:
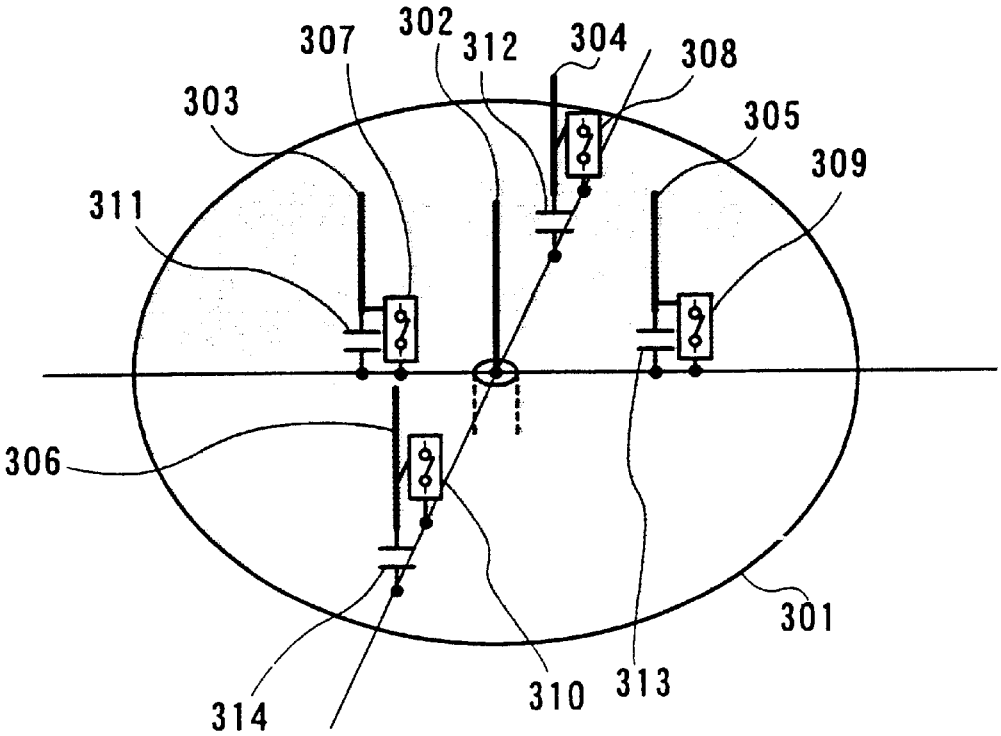
FIG. 11 is a diagram showing a first configuration of an antenna apparatus according to Embodiment 3 of the present invention.

FIG. 11 is a diagram showing a configuration of the antenna apparatus according to Embodiment 3.

As shown in FIG. 11, the antenna apparatus according to the present embodiment comprises antenna element 302 that acts as a radiator at the center of the upper surface of basic plate 301, antenna elements 303 to 306 that act as reflectors or directors arrayed concentrically so that their respective distance from antenna element 302 is ¼ wavelength or less. The antenna apparatus according to the present embodiment provides switch circuits 307 to 310 and capacitances 311 to 314 in parallel between one end of each of antenna elements 303 to 306 and basic plate 301, respectively.

Here, when switch circuit 307 is ON, if antenna element 303 is electrically continuous with basic plate 301 and if antenna element 303 is a little longer than antenna element 102 acts as a radiator, antenna element 303 acts as a reflector.

On the other hand, when switch circuit 307 is OFF, if capacitance 311 is set so that the phase of impedance produced by antenna element 303 and capacitance 311 lags behind antenna element 302, antenna element 303 acts as a director.

Likewise, when switch circuit 308 is ON, antenna element 304 acts as a reflector and when switch circuit 308 is OFF, antenna element 304 acts as a director. Furthermore, when switch circuit 309 is ON, antenna element 305 acts as a reflector and when switch circuit 309 is OFF, antenna element 305 acts as a director. Furthermore, when switch circuit 310 is ON, antenna element 306 acts as a reflector and when switch circuit 310 is OFF, antenna element 306 acts as a director.

That is, it is possible to make one of parasitic antenna elements act as a director and the others act as reflectors by switching ON/OFF of switch circuits so that one of switch circuits 307 to 310 is OFF and all the others are ON, making it possible to implement an antenna apparatus smaller than conventional apparatuses, capable of switching directivity by 90 degrees in 4 directions.

By the way, according to FIG. 11, all antenna elements 303 306 act as reflectors or directors by turning ON or OFF all switch circuits 307 to 310, and in this way it is possible to use this antenna apparatus as an isotropic antenna on a horizontal plane without performing complicated switching operations.

Figure 12:
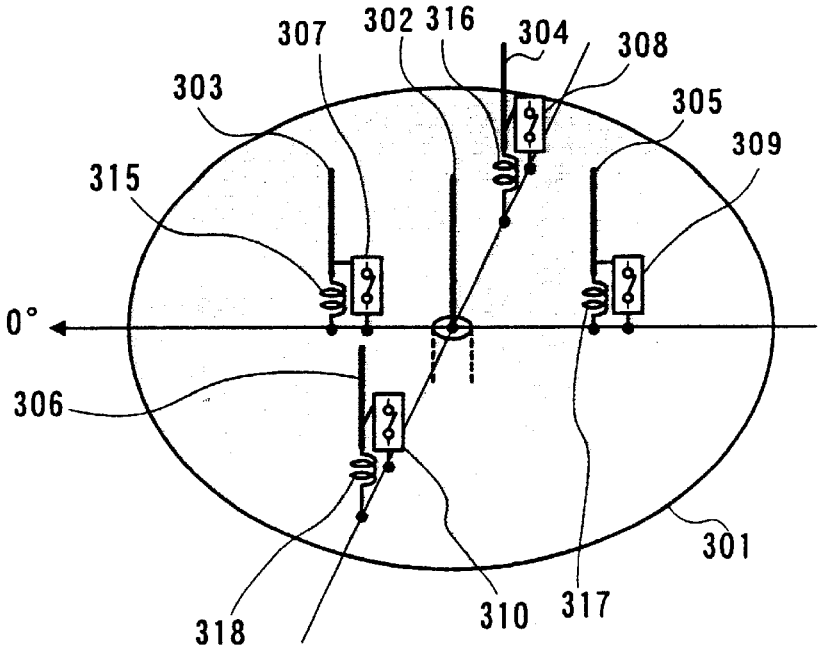
FIG. 12 is a diagram showing a second configuration of the antenna apparatus according to Embodiment 3 of the present invention.

As opposed to the antenna apparatus in FIG. 11, FIG. 12 shows a configuration of the antenna apparatus using inductances 315 to 318 instead of capacitances 311 to 314.

In the antenna apparatus in FIG. 12, when switch circuit 307 is ON, antenna element 303 is electrically continuous with basic plate 301 and antenna element 303 acts as a director. When switch circuit 307 is OFF, inductance 315 is loaded and antenna 303 acts as a reflector.

Likewise, when switch circuit 308 is ON, antenna element 304 acts as a director. When switch circuit 308 is OFF, antenna element 304 acts as a reflector. Furthermore, when switch circuit 309 is ON, antenna element 305 acts as a director. When switch circuit 309 is OFF, antenna element 305 acts as a reflector. Furthermore, when switch circuit 310 is ON, antenna element 306 acts as a director. When switch circuit 310 is OFF, antenna element 306 acts as a reflector.

Figure 13:
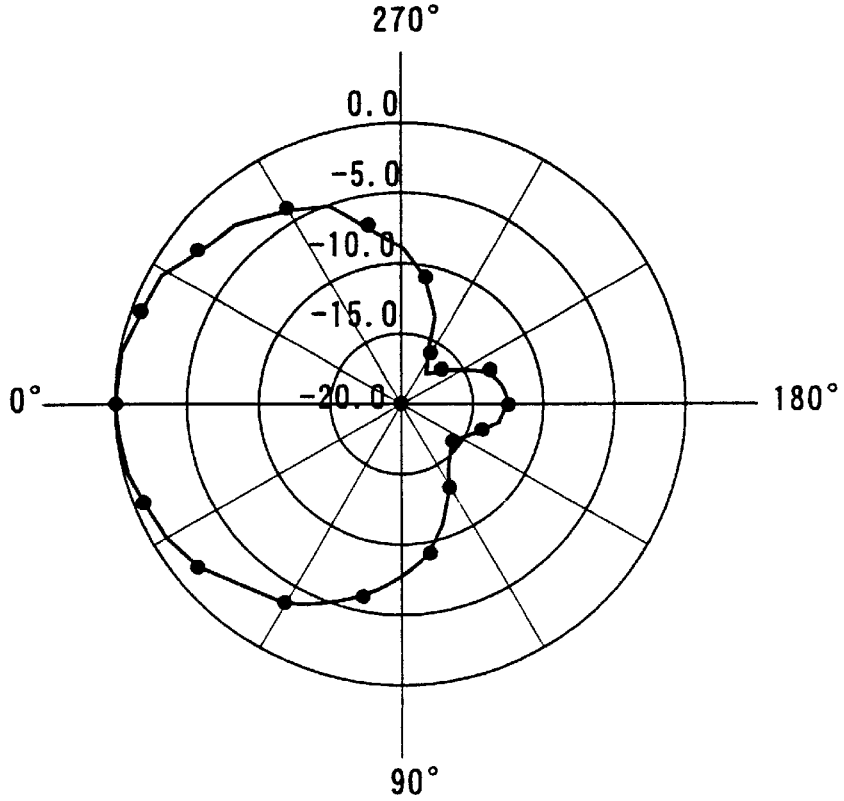
FIG. 13 is a directivity diagram of the antenna apparatus according to Embodiment 3 of the present invention.

FIG. 13 shows a directivity diagram showing actually measured values of directivity at 2 GHz of a specific example of the antenna apparatus in FIG. 12, with circular basic plate 201 of approximately 75 mm in diameter, antenna element 302 of approximately 34.5 mm in length, antenna elements 303 to 306 of approximately 34 mm in length, inductances 314 to 318 configured with a line distance of approximately 1 mm and a distribution constant of approximately 24 mm when shorted at one end, when switch circuit 307 is ON and switch circuits 308 to 310 are OFF.

As shown in FIG. 13, when switch circuit 307 is ON and switch circuits 308 to 310 are OFF, the direction of maximum radiation is toward antenna element 303. Likewise, when switch circuit 308 is ON and switch circuits 307, 309 and 310 are OFF, the direction of maximum radiation is toward antenna element 304. When switch circuit 309 is ON and switch circuits 307, 308 and 310 are OFF, the direction of maximum radiation is toward antenna element 305. When switch circuit 310 is ON and switch circuits 307 to 309 are OFF, the direction of maximum radiation is toward antenna element 306.

That is, the present embodiment makes one of the parasitic antenna elements act as a director and the others as reflectors by switching ON/OFF of the switch circuits so that one of the switch circuits 307 to 310 is ON and all the others are OFF, and in this way can implement an antenna apparatus smaller than conventional apparatuses and capable of switching directivity by 90 degrees in 4 directions.

By the way, according to FIG. 12, all antenna elements 303 to 306 act as reflectors or directors by turning ON or OFF all switch circuits 307 to 310, and in this way it is possible to use this antenna apparatus as an isotropic antenna on a horizontal plane without performing complicated switching operations.

Here, if the number of antenna elements is further increased compared to the present embodiment, it is possible to switch directivity in multiple directions according to the number of antenna elements by switching ON/OFF of switch circuits as in the case of the present embodiment.

(Embodiment 4)

Embodiment 4 adopts such a switch circuit configuration as to implement a high-gain antenna apparatus independent of impedance on the power supply side.

In FIG. 4 above, since the power supply section made up of switch 111, choke inductance 113 and capacitance 115 is connected in parallel with the diode element, when diode element 112 is turned OFF by the impedance on the power supply side, the impedance may decrease.

Figure 14:
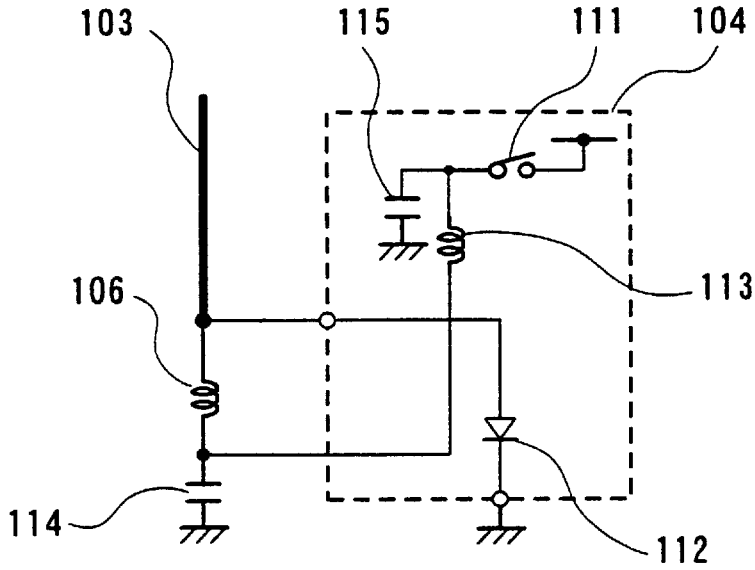
FIG. 14 is a diagram showing an internal configuration of a switch circuit of an antenna apparatus according to Embodiment 4 of the present invention.

FIG. 14 is a diagram showing a configuration example of switch circuit 104 of the antenna apparatus according to Embodiment 4 of the present invention. In FIG. 14, the components common to those in FIG. 4 are assigned the same codes as those in FIG. 4 and their explanations are omitted.

In the switch circuit shown in FIG. 14, the power supply is connected to the anode side of diode element 112 not directly but via inductance 106, and capacitance 114 is inserted between inductance 106 and the basic plate. This makes it possible to sufficiently lower impedance by means of high frequency, preventing the impedance on the power supply side from influencing diode element 112.

Thus, the present embodiment can improve the isolation characteristic when diode element 112 is turned OFF independently of the impedance on the power supply side, making it possible to achieve a high-gain antenna apparatus. Its capability of configuring the antenna independently of the impedance on the power supply side makes design easier.

(Embodiment 5)

Embodiment 5 adopts such a switch circuit configuration as to implement a high-gain antenna apparatus.

In FIG. 4 above, in order to achieve high gain for the antenna apparatus, when diode element 112 is turned ON, that is, when the antenna element is electrically continuous with the basic plate, it is ideal that the resistance of switch circuit 104 be 0Ω. However, because of the resistance component deriving from the characteristic of diode element 112 itself, it is impossible to reduce the resistance to 0Ω.

Figure 15:
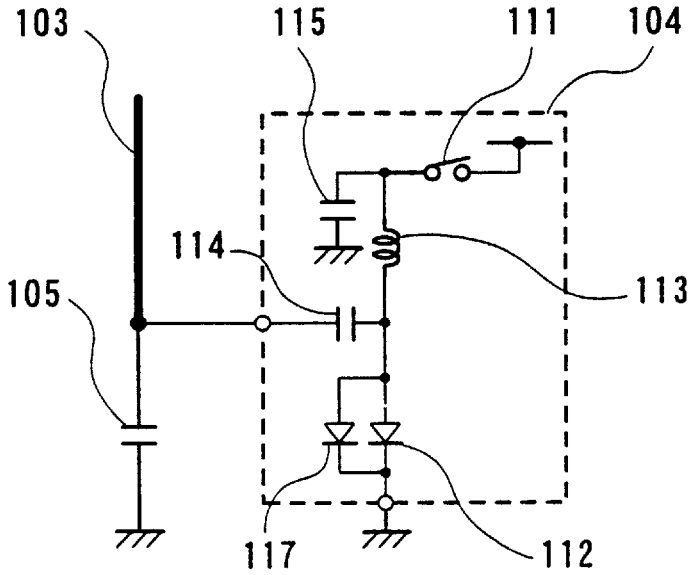
FIG. 15 is a diagram showing an internal configuration of a switch circuit of an antenna apparatus according to Embodiment 5 of the present invention.

FIG. 15 is a diagram showing a configuration example of switch circuit 104 of the antenna apparatus according to Embodiment 5 of the present invention. In FIG. 15, the components common to those in FIG. 4 are assigned the same codes as those in FIG. 4 and their explanations are omitted.

The switch circuit shown in FIG. 15 is different from the one in FIG. 4 in that diode element 121 is connected in parallel with diode element 112. Thus, connecting a plurality of diodes in parallel can reduce the resistance deriving from characteristics of diode elements themselves as a whole, making it possible to achieve higher gain than the antenna apparatus with the switch circuit in FIG. 4.

By the way, Embodiment 5 can be combined with Embodiment 4.

(Embodiment 6)

Embodiment 6 adopts such a switch circuit configuration as to reduce power consumption of an antenna apparatus.

Figure 16:
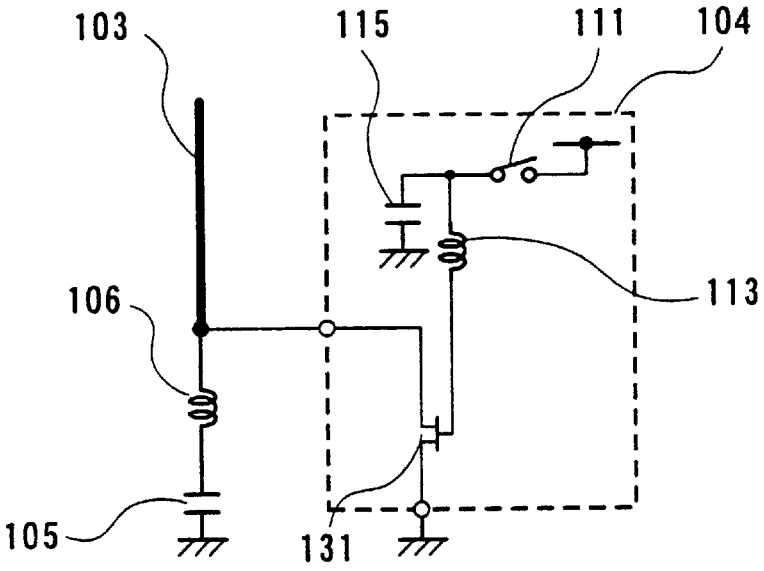
FIG. 16 is a diagram showing an internal configuration of a switch circuit of an antenna apparatus according to Embodiment 6 of the present invention.

FIG. 16 is a diagram showing a configuration example of switch circuit 104 of the antenna apparatus according to Embodiment 6 of the present invention. In FIG. 16, the components common to those in FIG. 4 are assigned the same codes as those in FIG. 4 and their explanations are omitted.

The switch circuit shown in FIG. 16 is different from the one in FIG. 4 in that field-effect transistor 131 is used instead of diode element 112 and capacitance 114. When a diode element is turned ON a current flows. The smaller its resistance, the greater the current. On the other hand, power consumption of a field-effect transistor when performing ON/OFF control is virtually zero. Using a field-effect transistor instead of a diode element can reduce power consumption of the antenna apparatus.

By the way, Embodiment 6 can be combined with Embodiment 4. In Embodiment 6, connecting field-effect transistors in parallel can achieve an antenna apparatus with higher gain for the same reason as in Embodiment 5.

(Embodiment 7)

Embodiment 7 adopts such a switch circuit configuration as to achieve a high-gain antenna apparatus without characteristic deterioration due to the connection of switch circuits.

In FIG. 4 above, when diode element 112 is turned OFF, leakage of high frequency wave is produced due to the capacitance component of diode element 112 itself, preventing sufficient isolation from being secured.

Figure 17:
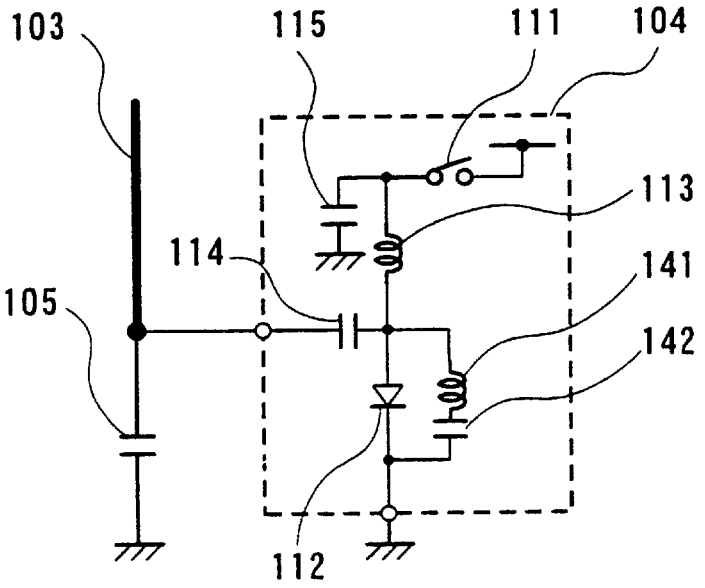
FIG. 17 is a diagram showing an internal configuration of a switch circuit of an antenna apparatus according to Embodiment 7 of the present invention.

FIG. 17 is a diagram showing a configuration example of switch circuit 104 of the antenna apparatus according to Embodiment 7 of the present invention. In FIG. 17, the components common to those in FIG. 4 are assigned the same codes as those in FIG. 4 and their explanations are omitted.

The switch circuit shown in FIG. 17 is different from the one in FIG. 4 in that inductance 141 and capacitance 142 are added in parallel with diode element 112. This cancels out the capacitance component of diode element 112 itself, making it possible to improve isolation characteristic and achieve a high-gain antenna apparatus without characteristic deterioration due to the connection of switch circuits.

By the way, Embodiment 7 can be combined with Embodiments 4 to 6.

(Embodiment 8)

The embodiments above described how to reduce the size of the apparatus by narrowing the distance between array antenna elements. However, narrowing the distance between array antenna elements involves a problem of reducing the impedance of radiators. Embodiment 8 of the present invention is an embodiment that solves this problem.

Figure 18:
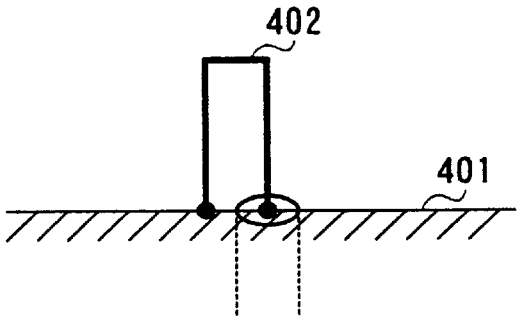
FIG. 18 is a diagram showing a first configuration of a radiator of an antenna apparatus according to Embodiment 8 of the present invention.

FIG. 18 is a diagram showing a first configuration of a radiator of the antenna apparatus according to the present embodiment. As shown in FIG. 18, the antenna apparatus according to the present embodiment has antenna element 402, which is used as a radiator, folded at a length of ¼ wavelength from the power supply point with its end shorted to basic plate 401, forming a folded antenna. The two antenna elements forming the folded antenna have a same wire diameter.

This increases the impedance by a factor of 4 compared with the case where a normal rectilinear antenna element is used as a radiator, making it easier to maintain consistency of impedance when the distance between array antenna elements is small and the impedance of the radiator decreases.

Figure 19:
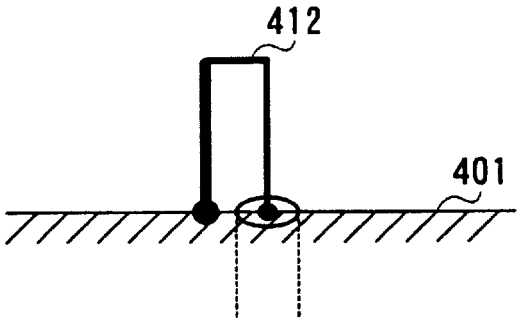
FIG. 19 is a diagram showing a second configuration of the radiator of the antenna apparatus according to Embodiment 8 of the present invention.

FIG. 19 is a diagram showing a second configuration of the radiator of the antenna apparatus according to the present embodiment. Antenna element 412 in FIG. 19 is different from antenna element 402 in FIG. 18 in that the two antenna elements forming a folded antenna have different wire diameters.

This allows the input impedance of the radiator to be arbitrarily changed, making it easier to maintain consistency of impedance.

By the way, Embodiment 8 can be combined with one of Embodiments 1 to 3 as appropriate.

(Embodiment 9)

Embodiment 9 adopts such a form of the antenna element used as a radiator as to reduce the size and widen the band of the radiator.

Figure 20:
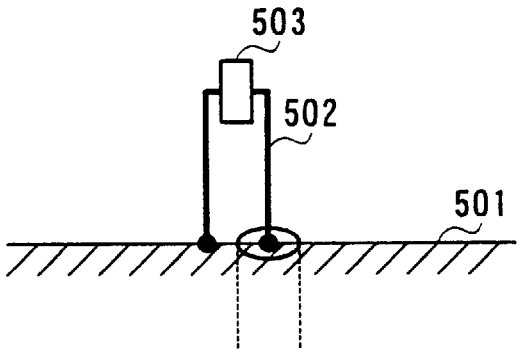
FIG. 20 is a diagram showing a first configuration of a radiator of an antenna apparatus according to Embodiment 9 of the present invention.

FIG. 20 is a diagram showing a first configuration of a radiator of the antenna apparatus according to the present embodiment. As shown in FIG. 20, the antenna apparatus according to the present embodiment has antenna element 502, which is used as a radiator, folded at a length of ¼ wavelength from the power supply point with its end shorted to basic plate 501, forming a folded antenna. Reactance 503 is inserted between the top ends of the two antenna elements forming the folded antenna.

This can shorten the antenna element compared with the case where a normal rectilinear antenna element is used as a radiator. This can also widen the band if antenna elements of the same length as antenna elements of a normal rectilinear form are used.

Figure 21:
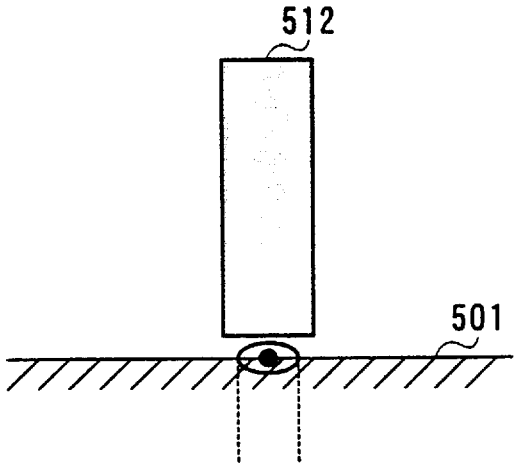
FIG. 21 is a diagram showing a second configuration of the radiator of the antenna apparatus according to Embodiment 9 of the present invention.

Moreover, as shown in FIG. 21, adopting antenna element 512 of a tabular form as a radiator can widen the band compared with the case where a normal rectilinear antenna element is used as a radiator.

Figure 22:
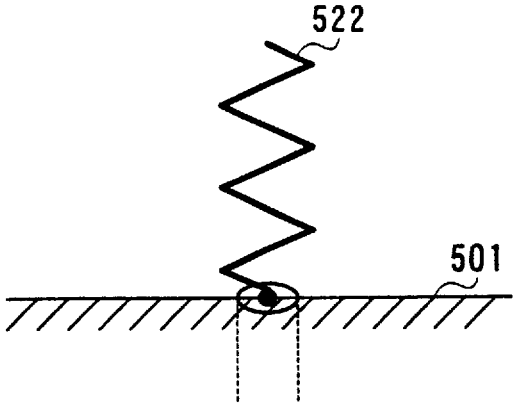
FIG. 22 is a diagram showing a third configuration of the radiator of the antenna apparatus according to Embodiment 9 of the present invention.

Moreover, as shown in FIG. 22, adopting antenna element 522 of a zigzag form as a radiator can shorten the antenna element compared with the case where a normal rectilinear antenna element is used as a radiator.

Figure 23:
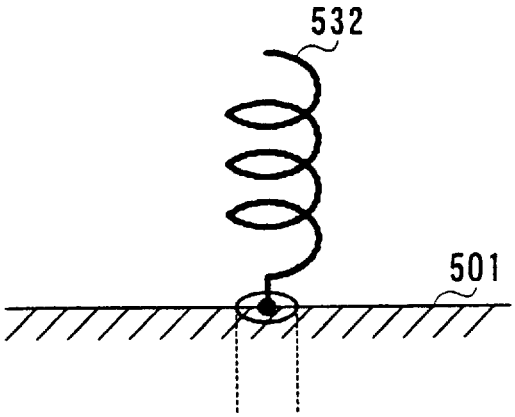
FIG. 23 is a diagram showing a fourth configuration of the radiator of the antenna apparatus according to Embodiment 9 of the present invention.

Moreover, as shown in FIG. 23, adopting antenna element 532 of a spiral form as a radiator can shorten the antenna element compared with the case where a normal rectilinear antenna element is used as a radiator.

By the way, Embodiment 9 can be combined with one of Embodiments 1 to 3 as appropriate.

(Embodiment 10)

Embodiments 1 to 3 have no restrictions on the form of the inductances used for the antenna apparatus. However, if a concentrated constant type inductance is used, there remains a problem of loss caused by self-resonance. Embodiment 10 adopts such a form of the inductance used for the antenna apparatus as to reduce or eliminate loss caused by self-resonance.

Figure 24:
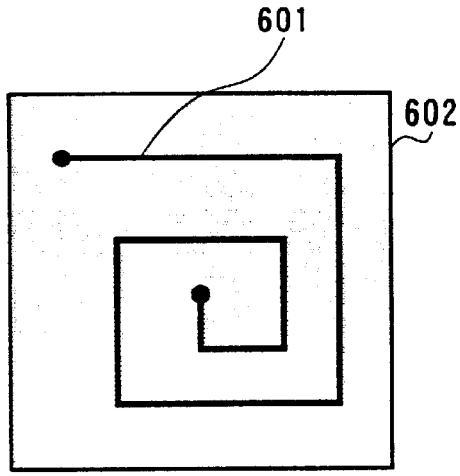
FIG. 24 is a diagram showing a first configuration of an inductance of an antenna apparatus according to Embodiment 10 of the present invention.

FIG. 24 is a diagram showing a first configuration of an inductance of the antenna apparatus according to the present embodiment. As shown in FIG. 24, inductance 601 is formed on printed circuit board 602.

This can implement an inductance with smaller loss and with a higher self-resonance frequency than chip parts, etc.

Figure 25:
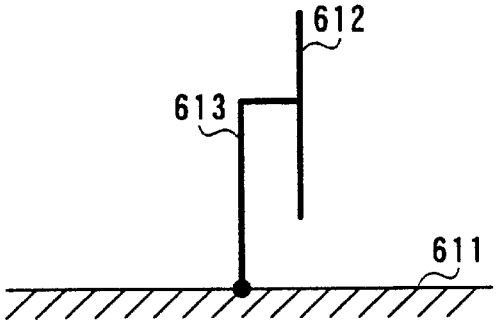
FIG. 25 is a diagram showing a second configuration of the inductance of an antenna apparatus according to Embodiment 10 of the present invention.

FIG. 25 is a diagram showing a second configuration of the inductance of the antenna apparatus according to the present embodiment. As shown in FIG. 25, a distribution type inductance is formed with two microstrip-figured wires 612 and 613 and one end of wire 613 is shorted to basic plate 611.

This can implement an inductance without loss or self-resonance frequency.

By the way, Embodiment 10 can be combined with Embodiments 1 to 9 as appropriate.

(Embodiment 11)

Embodiments 1 to 3 have no restrictions on the form of the capacitance used for the antenna apparatus. However, if a concentrated constant type capacitance is used, there remains a problem of loss caused by self-resonance. Embodiment 11 adopts such a form of the capacitance used for the antenna apparatus as to reduce or eliminate loss caused by self-resonance.

Figure 26:
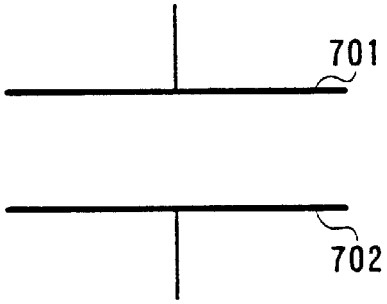
FIG. 26 is a diagram showing a first configuration of a capacitance of an antenna apparatus according to Embodiment 11 of the present invention.

FIG. 26 is a diagram showing a first configuration of a capacitance of the antenna apparatus according to the present embodiment. As shown in FIG. 26, a capacitance is formed between two conductor plates 701 and 702.

This can implement a capacitance with smaller loss go and with a higher self-resonance frequency than chip parts, etc.

Figure 27:
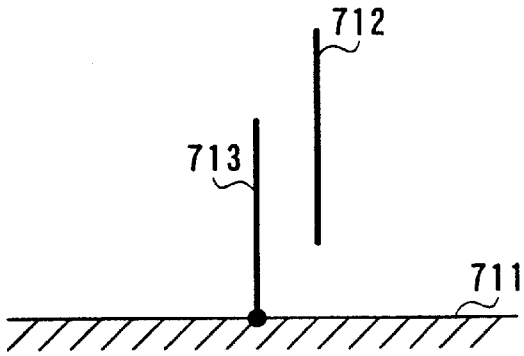
FIG. 27 is a diagram showing a second configuration of the capacitance of the antenna apparatus according to Embodiment 11 of the present invention.

FIG. 27 is a diagram showing a second configuration of the capacitance of the antenna apparatus according to the present embodiment. As shown in FIG. 27, a distribution type capacitance is formed with two microstrip-figured wires 712 and 713 and one end of wire 713 is shorted to basic plate 711.

This can implement a capacitance without loss or self-resonance frequency.

By the way, Embodiment 11 can be combined with Embodiments 1 to 9 as appropriate.

(Embodiment 12)

Embodiment 12 is an embodiment that adopts such a form of the basic plate as to improve antenna gain.

Figure 28A:
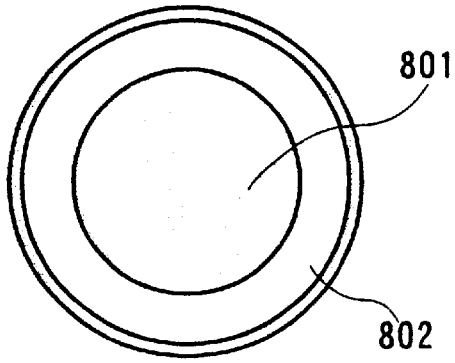
FIG. 28A is a top view of a basic plate of an antenna apparatus according to Embodiment 12 of the present invention.
Figure 28B:
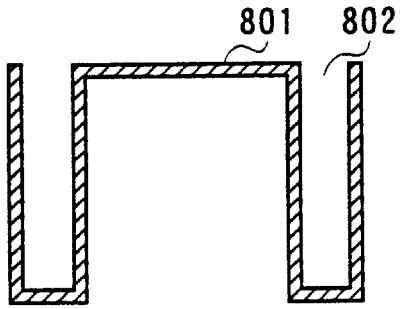
FIG. 28B is a front sectional view of the basic plate of the antenna apparatus according to Embodiment 12 of the present invention.

FIG. 28A is a top view of a basic plate of the antenna apparatus according to the present embodiment. FIG. 28B is a front sectional view of the basic plate of the antenna apparatus according to the present embodiment. As shown in FIG. 28, the antenna apparatus according to the present embodiment provides groove section 802 of approximately ¼ wavelength wide on the outer circumference of basic plate 801.

This makes the impedance of groove section 802 with respect to basic plate 801 infinite, suppresses an antenna current flowing onto the back of the basic plate, reduces radiation to the back of the basic plate and improves the antenna gain.

By the way, Embodiment 12 can be combined Embodiments 1 to 11 as appropriate.

(Embodiment 13)

Embodiment 13 is an embodiment intended to further reduce the size of the apparatus.

Figure 29:
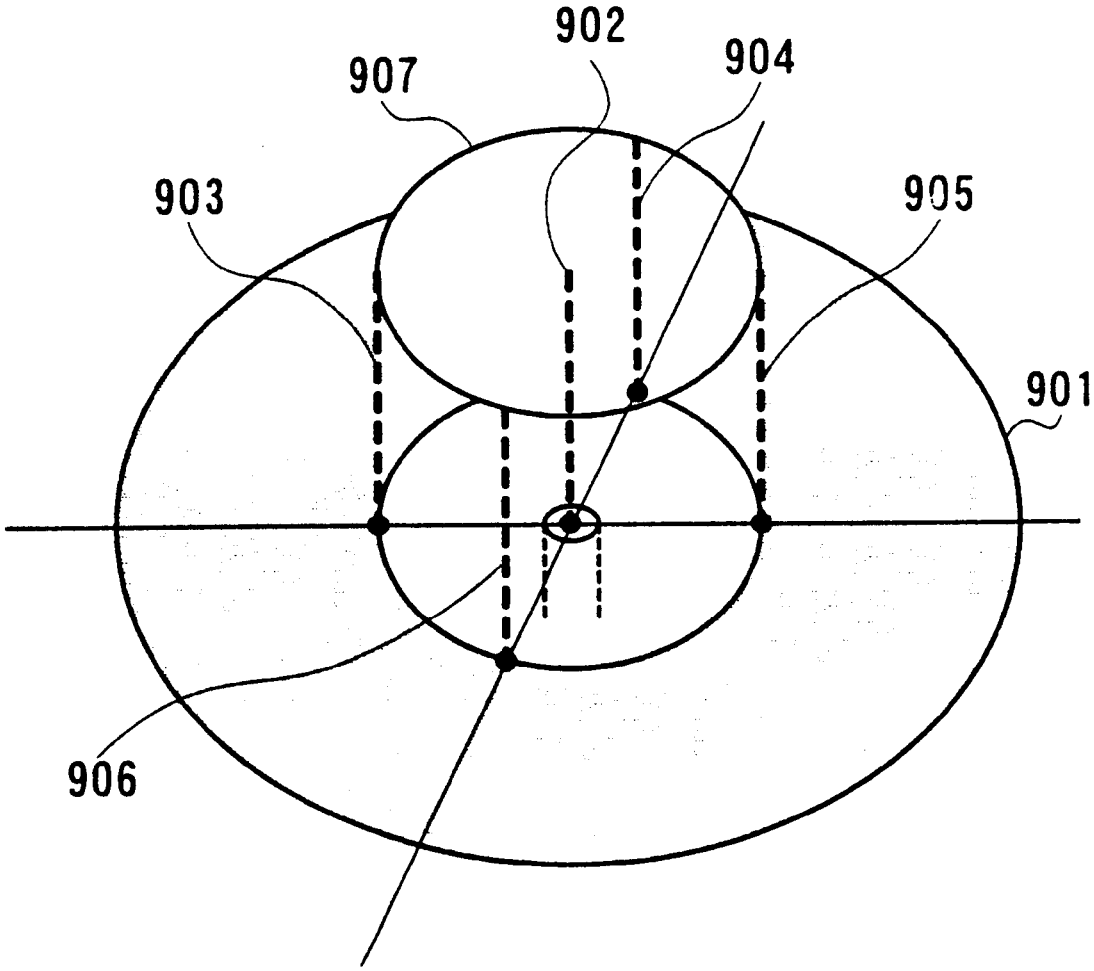
FIG. 29 is a diagram showing a configuration of an antenna apparatus according to Embodiment 13 of the present invention.

FIG. 29 is a diagram showing a configuration of a basic plate of the antenna apparatus according to the present embodiment. As shown in FIG. 29, the antenna apparatus according to the present embodiment fills antenna elements 902 to 906 acting as directors or reflectors shorted to basic plate 901 with dielectric material 907.

This produces a dielectric constant reducing effect, making it possible to shorten the antenna elements, narrow the distance between the antenna elements and further reduce the size of the apparatus.

By the way, Embodiment 13 can be combined with Embodiments 1 to 12 as appropriate.

As described above, the antenna apparatus of the present invention can reduce the size of the apparatus and switch directivity without reducing the antenna gain.

The present invention is not limited to the above described embodiments, and various variations and modifications may be possible without departing from the scope of the present invention.

This application is based on the Japanese Patent Application No.HEI 11-059449 filed on Mar. 5, 1999, the Japanese Patent Application No.HEI 11-139122 filed on May 19, 1999 and the Japanese Patent Application No.HEI 11-231381 filed on Aug. 18, 1999, entire content of which is expressly incorporated by reference herein.

What is claimed is:

1. An antenna apparatus comprising:

a first antenna element installed on a base plate for transmitting or receiving electromagnetic waves;

a parasitic second antenna element installed on said base plate;

a first capacitor provided between an end of said second antenna element and said base plate; and a switch circuit provided between, in parallel with said first capacitor, said end of said second antenna element and said base plate, for turning on to cause said second antenna element to act as a reflector and for turning off to cause said second antenna element to act as a director.

2. The antenna apparatus according to claim 1, wherein the apparatus comprises two said second antenna elements and switching circuits disposed symmetrically with respect to the first antenna element.

3. The antenna apparatus according to claim 1, wherein the apparatus comprises an even number of said second antenna elements and said switching circuits evenly spaced concentrically centered on the first antenna element.

4. The antenna element according to claim 1, wherein a length of said second antenna element when acting as a reflector is set by electrically turning on said second antenna element with said base plate when said switch circuit is turned on, while when said switch circuit is turned off, said first capacitance is set so that an impedance phase due to said second antenna element and said first capacitance lags behind said first antenna element, so as to cause said second antenna to act as a director.

5. The antenna apparatus according to claim 1, wherein the first capacitance is formed with two linear or microstrip-configured wires having one end open.

6. The antenna apparatus according to claim 1, wherein the apparatus comprises a plurality of said switch circuits placed in parallel.

7. The antenna apparatus according to claim 1, wherein the switch circuit is a field-effect transistor.

8. The antenna apparatus according to claim 1, wherein the switch circuit comprises an LC circuit, including an inductor and, a second capacitor placed in series, placed in parallel with the switch circuit.

9. The antenna apparatus according to claim 1, wherein the first antenna element is a folded antenna formed with an antenna element folded at a length of approximately ¼ wavelength from the power supply point with its one end shorted to the base plate.

10. The antenna apparatus according to claim 9, wherein the folded antenna includes two antenna elements having different wire diameters.

11. The antenna apparatus according to claim 9, wherein the folded antenna includes two antenna elements and a reactance is inserted between the two antenna elements forming the folded antenna.

12. The antenna apparatus according to claim 1, wherein a groove section of approximately ¼ wavelength and whose one end is shorted is provided on the outer circumference of the base plate.

13. The antenna apparatus according to claim 1, wherein a dielectric material is filled between the first antenna element and the second antenna element.

14. A communication terminal apparatus with an antenna apparatus, said antenna apparatus comprising:

a first antenna element installed on a base plate for transmitting or receiving electromagnetic waves;

a parasitic second antenna element installed on said base plate;

a first capacitor provided between an end of said second antenna element and said base plate; and a switch circuit provided between, in parallel with said first capacitor, said end of said second antenna element and said base plate, for turning on to cause said second antenna element to act as a reflector and for turning off to cause said second antenna element to act as a director.

15. A communication terminal apparatus with an antenna apparatus, said antenna apparatus comprising:

a first antenna element installed on a base plate for transmitting or receiving electromagnetic waves;

a parasitic second antenna element installed on said base plate;

an inductor provided between an end of said second antenna element and said base plate; and a switch circuit provided between, in parallel with said inductor, said end of said second antenna element and said base plate, for turning on to cause said second antenna element to act as a reflector and for turning off to cause said second antenna element to act as a director.

16. An antenna directivity switching method, comprising:

placing a first antenna element for transmitting or receiving electromagnetic waves and a parasitic second antenna element on a base plate, placing a switch circuit and capacitor in parallel between one end of said second antenna element and said base plate, and turning on said switch circuit to cause said second antenna element to act as a reflector and turning off said switch circuit to cause said second antenna element to act as a director.

17. An antenna directivity switching method, comprising:

placing a first antenna element for transmitting or receiving electromagnetic waves on a base plate, placing a first parasitic second antenna element and a second parasitic second antenna element on the base plate symmetrically with respect to said first antenna element, placing a first switch circuit and a first capacitor in parallel between one end of said first parasitic second antenna element and said base plate and placing a second switch circuit and a second capacitor in parallel between one end of said second parasitic second antenna element and said base plate, turning on said first switch circuit to cause said first parasitic second antenna element to act as a reflector and turning off said first switch circuit to cause said first parasitic second antenna element to act as a director and turning on said second switch circuit to cause said second parasitic second antenna element to act as a reflector and turning off said second switch circuit to cause said second parasitic second antenna element to act as a director, wherein when said first switch circuit is turned on, said second switch circuit is turned off and when said first switch circuit is turned off, said second switch circuit is turned on.

18. An antenna directivity switching method, comprising:

placing a first antenna element for transmitting or receiving electromagnetic waves a base plate, placing an even number of parasitic second antenna elements on the base plate evenly spaced concentrically centered on said first antenna element, placing a switch circuit and capacitor in parallel between one end of each of said second antenna elements and said base plate, and turning off one of said switch circuits to cause the one of said second antenna elements associated therewith to act as a director and turning on all other ones of said switch circuits to cause the ones of said second antenna elements associated therewith to act as reflectors.

19. An antenna directivity switching method, comprising:

placing a first antenna element for transmitting or receiving electromagnetic waves and a parasitic second antenna element on a base plate, placing a switch circuit and inductor in parallel between one end of said second antenna element and said base plate, and turning on said switch circuit to cause said second antenna element to act as a reflector and turning off said switch circuit to cause said second antenna element to act as a director.

20. An antenna directivity switching method, comprising:

placing a first antenna element for transmitting or receiving electromagnetic waves on a base plate, placing a first parasitic second antenna element and a second parasitic second antenna element on the base plate symmetrically with respect to said first antenna element, placing a first switch circuit and a first inductor in parallel between one end of said first parasitic second antenna element and said base plate and placing a second switch circuit and a second inductor in parallel between one end of said second parasitic second antenna element and said base plate, performing control including turning on said first switch circuit to cause said first parasitic second antenna element to act as a reflector and turning off said first switch circuit to cause said first parasitic second antenna element to act as a director and turning on said second switch circuit to cause said second parasitic second antenna element to act as a reflector and turning off said second switch circuit to cause said second parasitic second antenna element to act as a director, wherein when said first switch circuit is turned on, said second switch circuit is turned off and when said first switch circuit is turned off, said second switch circuit is turned on.

21. An antenna directivity switching method, comprising:

placing a first antenna element for transmitting or receiving electromagnetic waves on a base plate, placing an even number of parasitic second antenna elements on the base plate evenly spaced concentrically centered on said first antenna element, placing a switch circuit and inductor in parallel between one end of each of said second antenna elements and said base plate, and performing control including turning off one of said switch circuits to cause the one of said second antenna elements associated therewith to act as a director and turning on all other ones of said switch circuits to cause the ones of said second antenna elements associated therewith to act as reflectors.

22. An antenna apparatus comprising:

a first antenna element installed on a base plate for transmitting or receiving electromagnetic waves;

a parasitic second antenna element installed on said base plate;

a first inductor provided between an end of said second antenna element and said base plate; and a switch circuit provided between, in parallel with said first inductor, said end of said second antenna element and said base plate, for turning on to cause said second antenna element to act as a reflector and for turning off to cause said second antenna element to act as a director.

23. The antenna apparatus according to claim 22, wherein the apparatus comprises two said second antenna elements and switching circuits disposed symmetrically with respect to the first antenna element.

24. The antenna apparatus according to claim 22, wherein the apparatus comprises an even number of said second antenna elements and said switching circuits evenly spaced concentrically centered on the first antenna element.

25. The antenna element according to claim 22, wherein a length of said second antenna element when acting as a reflector is set by electrically turning on said second antenna element with said base plate when said switch circuit is turned on, while when said switch circuit is turned off, said first inductor is equivalent, so as to cause said second antenna to act as a director.

26. The antenna apparatus according to claim 22, wherein the first capacitance is formed with two linear or microstrip-configured wires having one end open.

27. The antenna apparatus according to claim 22, wherein the switch circuit includes a second capacitor between the first inductor and the base plate and supplies a voltage for operating the switch circuit between the first inductor and the second capacitor.

28. The antenna apparatus according to claim 22, wherein the apparatus comprises a plurality of said switch circuits placed in parallel.

29. The antenna apparatus according to claim 22, wherein the switch circuit is a field-effect transistor.

30. The antenna apparatus according to claim 22, wherein the switch circuit comprises an LC circuit, including an inductor and a second capacitor placed in series, placed in parallel with the switch circuit.

31. The antenna apparatus according to claim 22, wherein the first antenna element is a folded antenna formed with an antenna element folded at a length of approximately ¼ wavelength from the power supply point with its one end shorted to the base plate.

32. The antenna apparatus according to claim 31, wherein the folded antenna includes two antenna elements having different wire diameters.

33. The antenna apparatus according to claim 31, wherein the folded antenna includes two antenna elements and a reactance is inserted between the two antenna elements forming the folded antenna.

34. The antenna apparatus according to claim 22, wherein a groove section of approximately ¼ wavelength and whose one end is shorted is provided on the outer circumference of the base plate.

35. The antenna apparatus according to claim 22, wherein a dielectric material is filled between the first antenna element and the second antenna element.

* * * * *